United States Patent [19]

Cash et al.

[11] 4,345,518

[45] Aug. 24, 1982

[54] CAN CRUSHER

[75] Inventors: Jon B. Cash; Paul K. Ludwig, both of San Bruno, Calif.

[73] Assignee: Krushko, San Bruno, Calif.

[21] Appl. No.: 240,717

[22] Filed: Mar. 5, 1981

Related U.S. Application Data

[63] Continuation-in-part of Ser. No. 124,151, Feb. 25, 1980, abandoned.

[51] Int. Cl.[3] ..... B30B 9/32

[52] U.S. Cl. ..... 100/98 R; 100/269 R; 100/293; 100/902

[58] Field of Search ..... 100/293, 902, 291, 292, 100/266, 269 R, 233, 42, 98 R, 232

[56] References Cited

U.S. PATENT DOCUMENTS

| | | | |
|---|---|---|---|
| 2,958,273 | 11/1960 | Morrow | 100/902 |
| 3,106,888 | 10/1963 | Chapleau | 100/902 |
| 3,732,804 | 5/1973 | Moller | 100/902 |
| 3,777,659 | 12/1973 | McCarten | 100/902 |
| 3,780,647 | 12/1973 | Reimers | 100/232 |
| 3,889,587 | 6/1975 | Wharton | 100/902 |
| 3,934,498 | 1/1976 | Hochanadel | 100/902 |

FOREIGN PATENT DOCUMENTS

| | | | |
|---|---|---|---|
| 1156139 | 6/1969 | United Kingdom | 100/902 |
| 2011302 | 7/1979 | United Kingdom | 100/902 |

*Primary Examiner*—Billy J. Wilhite

*Attorney, Agent, or Firm*—Townsend and Townsend

[57] ABSTRACT

An improved can crusher which has a pair of pivotal arms responsive to the position of a piston within an elongated, base mounted tube for denting or creasing and piercing the side of the can prior to the crushing the can by the piston. The piston is activated with a pivotable handle which engages the piston through apertures in the tube. The pivot arms are mounted to the outside of the tube and their ends remote from the base are biased toward the axis of the tube into engagement with the side of the piston. As the piston moves towards the can, the protruding portions of the upper ends of the pivot arms are forced away from the axis of the tube thus forcing protruding portions on the lower ends of the arms into the side of the can, thereby piercing and denting the can. As the piston crushes the can, the lower protruding portion is pivoted away from the can by the action of a biasing spring. The end of the pivotal handle can be curved to reduce off-axis forces on the piston.

6 Claims, 6 Drawing Figures

CAN CRUSHER

RELATED APPLICATIONS

This is a continuation-in-part application of U.S. patent application Ser. No. 124,151 filed Feb. 25, 1980, now abandoned.

This invention is related to can crushers, particularly to the type which weakens the can by first denting the side of the can prior to axially crushing it.

BACKGROUND OF THE INVENTION

The need to crush empty cans has become increasingly great in recent years. This applies especially to readily recyclable aluminum cans which do not normally decompose and therefore present a serious disposal problem. Often persons who may wish to save aluminum cans for recycling are deterred from doing so because of the bulkiness of empty cans and the significant labor that is required to crush the cans by stepping on them, for example. As a result, can crushers have been developed.

The prior art can crushers, such as those disclosed in U.S. Pat. Nos. 3,732,804; 3,780,647 and 3,934,498, as well as British Pat. No. 1,156,139 have recognized the need to indent the side of the can to weaken it prior to crushing. Heretofore the means for indenting the side of the can have been quite complex, expensive and failure prone. Further, some can crushers obliterate the ends of the cans when crushing them. Such crushes are not suitable for areas where beverage cans have had a deposit paid on them. In such an event one end of the can typically receives a special mark or designation. If the can end is obliterated, the deposit might not be collectable.

SUMMARY OF THE INVENTION

The present invention provides a can crusher which axially flattens the cans to leave their ends unobliterated for identification purposes. To reduce the crushing force, side-denting arms are pointed to pierce the sides of the can so that the sidewalls can tear while being crushed. The can crusher is simple, rugged, and can be constructed of a few parts. It is therefore both durable and relatively inexpensive to obtain, operate and maintain. It is adapted to be used when large volumes of cans need to be crushed as, for example, at public recycling centers. Yet it is sufficiently inexpensive so that it can be advantageously used by individuals for crushing cans used in a single household, for example.

Broadly speaking the can crusher of the invention has a frame that includes an elongate cavity which holds a can for crushing by a piston that is axially movable within the cavity. Means is provided for urging the piston toward the can from a first position in which the piston clears the can to a second position in which it interferes with the can so that the can is crushed when the piston is moved from the first to the second position. The crusher further includes means responsive to the relative location of the piston in the cavity for deforming and piercing a side of the can to facilitate its crushing.

In a presently preferred embodiment, the frame of the crusher is defined by a base and a tube protruding transversely away therefrom. The tube defines the cavity and has a first cutout proximate the base which is sized to permit the insertion of the can therethrough into the cavity and an additional length terminating in a free end spaced from the cutout and from the base.

The can's side is deformed by a detent arm mounted to the exterior of the tube and generally parallel to the axis of the cavity. The arm is pivotable about an axis that is transverse to the axis of the cavity and defines first and second arm portions located, respectively, between the ends of the can in the cavity and at the additional tube length. The tube further includes slots that are arranged so that the first and second arm portions can alternatively enter the cavity when the arm is pivoted in opposite directions and a spring is provided for pivotally biasing the arm so that the second portion normally extends into the cavity. The arm is of a simple, inexpensive construction and is readily accessible. Maintenance or replacement that may from time to time be required is simple and can be readily performed to prevent long down times and costly repairs.

The piston has extension means which engage the second arm portion when the piston moves from the first to the second position and which pivotally moves the arm against the force exerted by the spring to enter the first arm portion into the cavity, engage a side of the can in the cavity with the first arm portion, and deform the can side before the piston end contacts the can to facilitate the crushing of the can by the piston. The first arm portion is pointed so that the side of the can is pierced as well as dented. This allows the side of the can to rip as well as buckle when crushed so that the axial force required is reduced. The piston is constructed so that the spring can pivot the arm and the second arm portion can enter into the cavity before the piston arrives at its second position to thereby correspondingly retract the first arm portion from the cavity and prevent the first arm portion from interfering with the crushing of the can by the piston.

To facilitate the withdrawal of the crushed can, by gravity when the base is mounted to an upright wall, the tube includes a second cutout that is generally diametrically opposite from the first cutout and which is dimensioned so that the crushed can can readily pass through it. In this manner the crushed can removal is practically automatic either by gravity or by being pushed out when the next can is inserted in the cavity. This significantly increases the operating speed of the crusher without noticeably adding to its cost. The use of the first cutout adjacent the base permits direct loading of the can into the cavity. This reduces the length of stroke required of the piston and this allows the can crusher to be more compact and further speeds its operation compared with prior art can crushers.

The piston can be power driven, as with a hydraulic or pneumatic drive, or it can be manually operated. In the latter case the additional length of the tube preferably has first and second generally diametrically opposite slots, one of which communicates with the first cutout. The piston includes first and second generally diametrically opposite apertures which are aligned with the slots and an elongate handle is provided which has a first length that extends generally radially through the slots and the apertures. A second length of the handle is gripped by the operator and extends away from the tube. The handle is mounted to the base to permit pivotal handle motions about a pivot axis located between the first and second handle lengths so that a pivotal movement of the handle causes corresponding axial movements of the piston along the cavity.

DESCRIPTION OF THE PREFERRED EMBODIMENT

Figure 1:
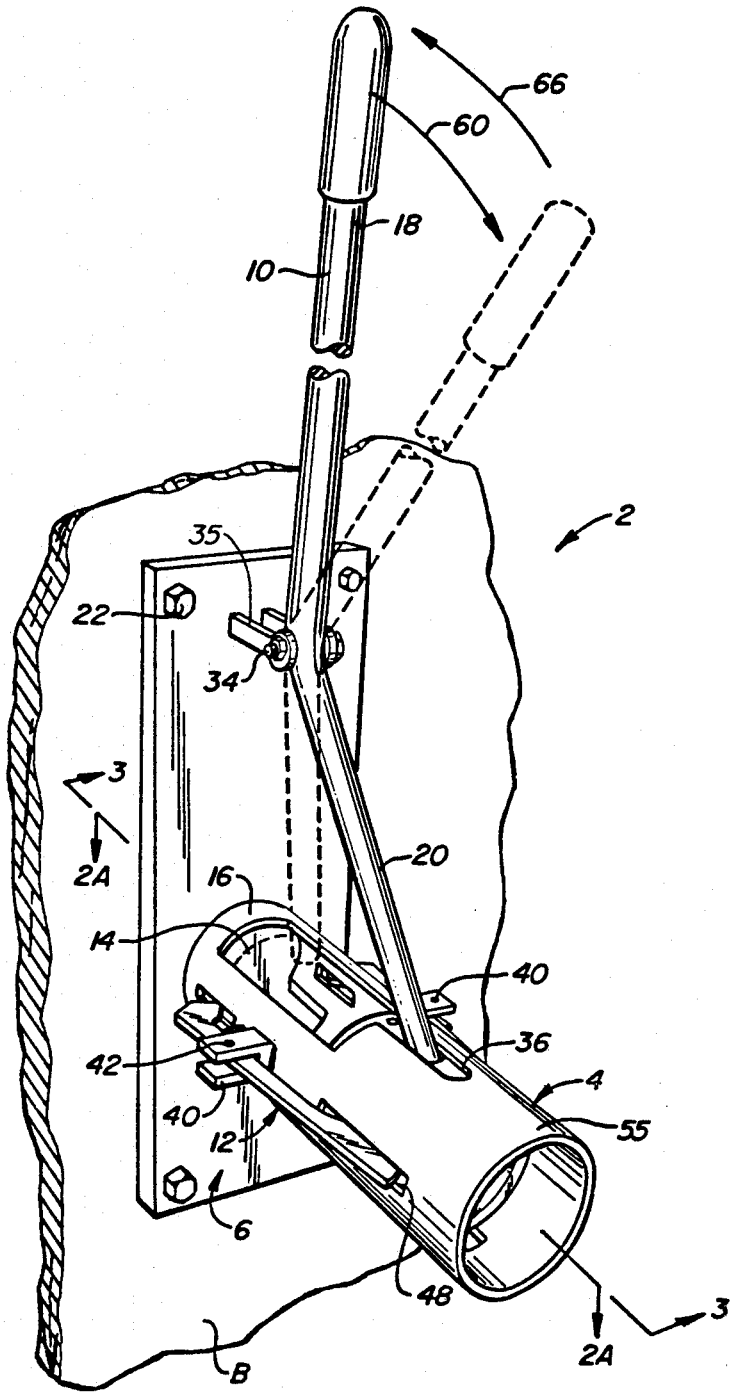
FIG. 1 is a perspective view of the can crusher of the present invention shown mounted to a wall.

Turning now to the Figures, the can crusher 2 generally comprises an elongated tube 4 mounted upright on a base 6. A crushing piston 8 is disposed within the interior cavity of the tube and is moved along the axis of the tube by a generaly L-shaped handle 10 which is pivotally mounted to the base. Movement of the piston along the axis of the tube causes a pair of coacting pivot arms 12 mounted to the side of the tube to both dent or crease and puncture the side of a can A placed within the tube adjacent to the base prior to the can being crushed by the piston.

Elongated tube 4 is securely mounted to base 6 by integrally constructing it therewith (e.g. when the tube and the base are molded from plastic), by bolting it to the base, welding or the like. Normally the base is mounted to an upright wall B with bolts 22 or the like. The tube has a first cutout 14, shown in FIG. 1, located adjacent to the lower end of the tube 16 and sized so that a can can be inserted through the cutout into the tube cavity. For the purpose of this description, and the claims, the term "lower" will sometimes be used to denote "close to" the base, while the term "upper" will be used to denote the opposite, i.e. relatively remote from the base.

Piston 8 is driven along the axis of the tube cavity by the L-shaped handle which is pivotable about a pivot pin 34 carried by posts 35 projecting from the base. The pivot pin engages the handle where the diverging handle grip portion 18 and the piston engaging portion 20 of the handle intersect. The grip portion 18 of the handle is typically significantly longer than the piston engaging portion 20 of the handle to provide the user with a significant mechanical advantage when crushing can A.

Figure 3:
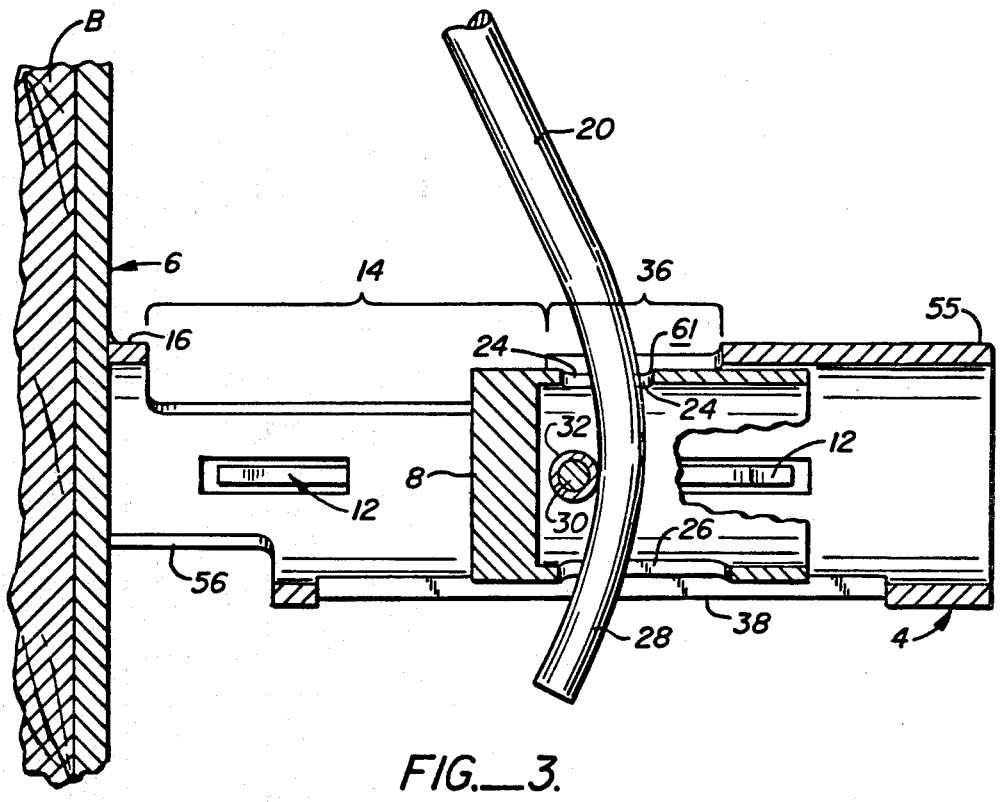
FIG. 3 is a cross-sectional view of the tube showing the piston engaging portion of the handle.

The tube includes diametrically opposite slots 36, 38, and the piston includes aligned apertures 24, 26 for receiving an end 28 of the piston engaging portion of the handle. Handle end 28 is arcuate and in use supplies the downward, can crushing force to the piston. Handle end 28 may engage the piston walls where it extends through the piston apertures or a pin 30 may be provided which is mounted to the sides of the piston. The pin passes through the axis of the piston in a direction transverse to the handle. A roller bearing 32 can be placed over the pin to reduce friction. Further, lateral forces on the piston are substantially reduced or eliminated by forming end 28 downwardly concave, as best seen in FIG. 3. The concave curvature of end 28 is chosen so that no matter what the position of the piston along the axis of the tube is, the plane which is tangent to the area of intersection between the handle end and the bearing is generally perpendicular to the axis of the tube.

Figure 4:
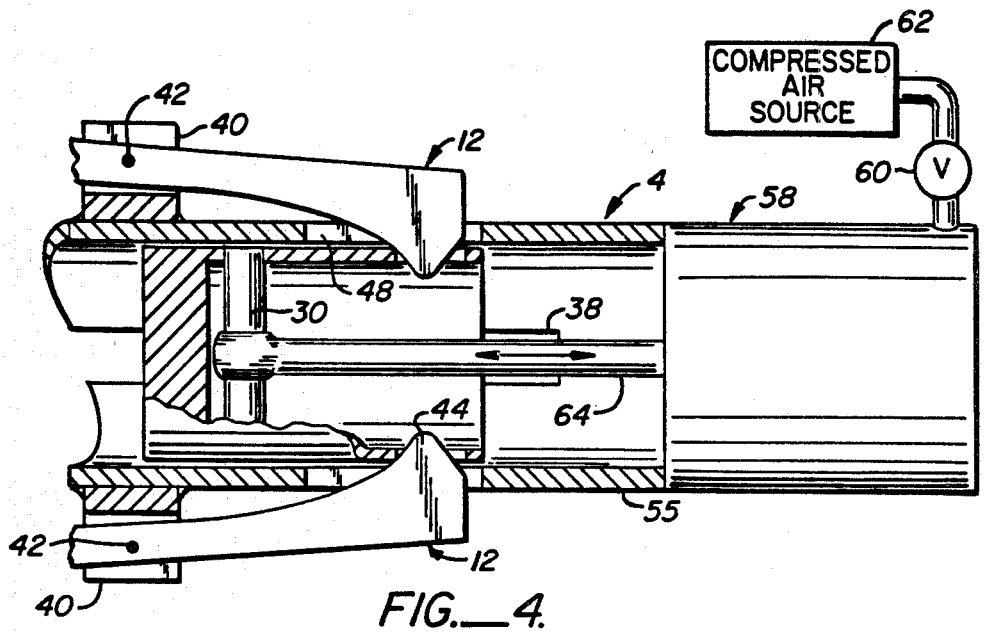
FIG. 4 is a partial view of the upper end of the tube of an alternative embodiment showing a pneumatic piston drive mounted thereto.

For certain applications, particularly when a large volume of cans must be crushed, the handle 10 can be replaced with a power drive. For example, a pneumatic (or hydraulic) piston drive 58 (shown in FIG. 4) can be mounted to an upper end 55 of the tube. Drive 58 is conventionally actuated with compressed air from a compressed air source 62. In such an event a piston rod 64 engages transverse pin 30 and forces the piston toward lower end 16 onto the can and back toward upper end 55.

Figure 2A:
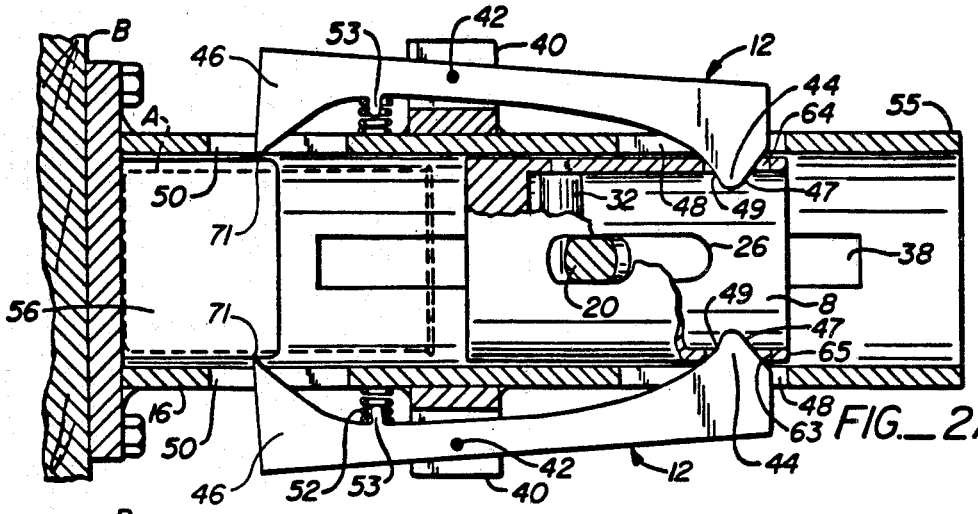
FIGS. 2A, 2B, 2C are cross-sectional views of the tube and associated components illustrating the piston in three positions.
Figure 2B:
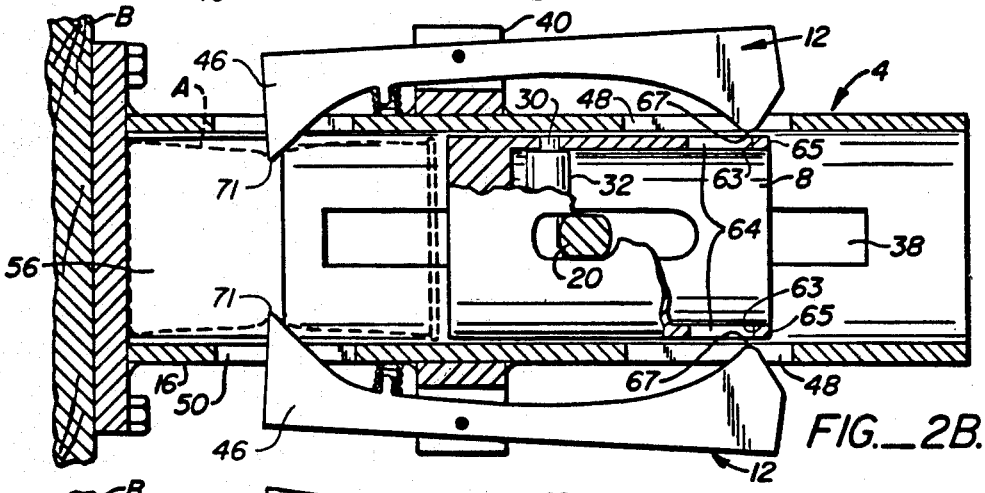
Figure 2C:
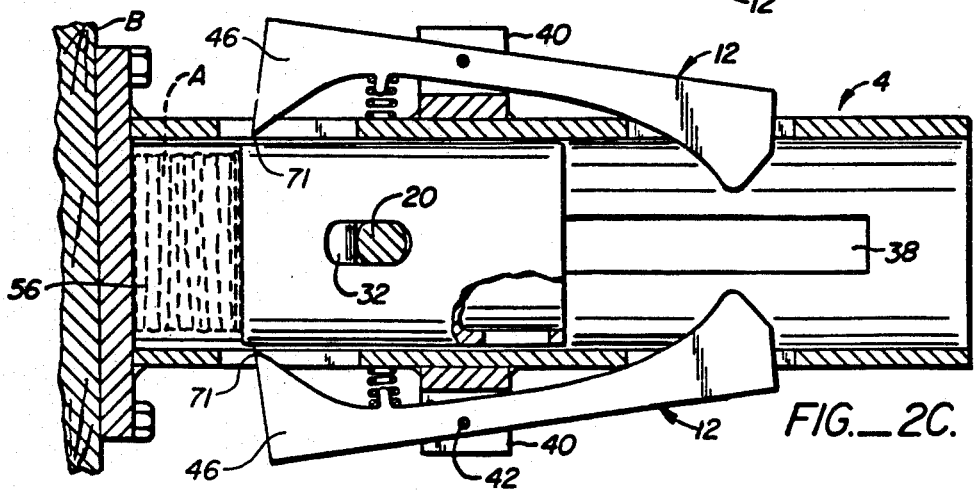

To facilitate the crushing of cans, which exhibit significant resistance to axial compression while in their original form, their sides are both deformed or dented and preferably are pierced preparatory to crushing. Referring now particularly to FIGS. 2A, 2B and 2C, pivot arms 12 are provided for this purpose. The arms are pivotable about a pivot pin 42 carried by spaced-apart brackets 40 projecting radially from the exterior of tube 4. Preferably, the brackets are positioned approximately 90° from slots 36, 38 in the tube and at approximately the height of the top of the undeformed can A on base 6. The pivot pins are perpendicular to the axis of the tube and the brackets are positioned so that the arms 12 pivot in a plane which passes through the tube axis.

The arms have upper and lower projecting portions 44, 46 which face toward the tube cavity. The tube has upper and lower slots 48, 50 which are aligned with the pivot arms and positioned so that the projections 44, 46 can alternatively enter through the slots into the cavity of the tube when the arms are pivoted about pin 42. A spring, such as a helical compression spring 52, is mounted between each arm and the outside of the tube, and is centered over a stub 53 or the like on the arm which is positioned so that the spring pivotally biases the upper projection 44 of the associated arm towards the tube cavity. For purposes further described below, the upper projection is defined by an upper, generally upwardly facing surface 47, and a downwardly oriented surface 49 (facing towards base 6). Both surfaces are angularly inclined relative to the axis of the tube cavity.

Piston 8 includes diametrically opposite, generally rectangular, apertures 64 which end short of the piston ends to define opposing, upper and lower arm engaging edges or surfaces 63, 65, respectively. The arm engaging surfaces 63, 65 are located relative to the obliquely inclined projection surfaces 47, 49 so that the arms are pivoted at the desired moments and in the desired directions during the crushing of the can. Specifically, the surfaces are arranged so that upper pivot arm projections 44 can enter the tube cavity when the piston is retracted, that is when the piston is in its upper position (FIG. 2A) to allow the insertion of a new can for crushing. It will be noted that compression springs 53 bias the arms into that position.

When a can is to be crushed, handle 10 is operated to axially move the piston in a downward direction. Arm surface 47 and piston surface 63 are arranged so that they engage during the downward motion of the piston. Upon the engagement of the surfaces, the downward motion of the piston pivots the arms against the force of the springs 53 so that the upper projections 44 are retracted from the tube cavity while the lower projections 46 are forced into the cavity. Since the lower projections overlie the axial extent of can A, the inward pivotal motion deforms or dents the sides of the can, thereby greatly reducing the force that is required for axially compressing and thereby crushing it. Further, by configuring lower portions 46 to have a sharp point 71, portions 46 also pierce the sides of the cans as well as deforming it. This allows the sides to both tear and collapse in response to the axial movement of piston 8. Additional reduction in crushing force is thereby achieved.

As piston 8 continues to move downwardly, the apex 67 of the upper arm projections 44 slides along the exterior side of the piston until it engages the upper surface or edge 65 of the piston. Further downward movement of the piston permits the downwardly facing, obliquely inclined arm surface 49 to slide inwardly, towards the tube cavity under the biasing force of spring 53, thereby retracting the lower arm projections 46 and permitting the unconstrained crushing of the can by the downwardly moving piston to the lowest possible height.

Upon the withdrawal of the piston, the upper projection surfaces 47, 49 engage the arm actuating surfaces 63, 65 of the piston in reverse order until the piston reaches its fully withdrawn position illustrated in FIG. 2A. At that point, the lower pivot arm projections 46 are retracted out of the tube cavity, the just crushed can can be withdrawn from the cavity and a new can can be inserted through cutout 14.

To facilitate the removal of the crushed can, can-removal aperture 56 is located adjacent to the base and opposite the can insertion cutout 14. Aperture 56 is significantly smaller than the insertion cutout to assure that a newly inserted can will be retained in the tube cavity until after it is crushed. The removal aperture has a sufficient size to allow the crushed can to be readily removed therethrough. When the base is mounted to a horizontal wall, it is arranged so that the removal aperture faces downwardly. In this manner the crushed can drops gravitationally from the tube cavity which greatly speeds up the crushing operation since it eliminates the need for manually removing it. But even if the base were mounted horizontally, the removal aperture permits a virtually automatic ejection of the crushed can since the insertion of a fresh can through cutout 14 necessarily forces the crushed can out of the tube cavity through the removal aperture.

The can crusher of the present invention is well suited for use in combination with an automatic can feeder to load cans into the tube through the can-insertion cutout 14. Such a feeder will typically be responsive to the position of the piston or to the piston actuating mechanism. The can-removal aperture eliminates the need for separate can removal apparatus for the reasons discussed above.

The operation of the can crushing apparatus should now be apparent. To briefly summarize it, with the piston in the upper load position, as shown in FIG. 2A, can A is inserted through cutout 14. The handle is then pulled in the direction of arrow 60 in FIG. 1 to force the piston downwardly towards the base. The downward motion of the piston causes the upper projections 44 of the pivotal arms 12 to be forced outwardly in opposition to the biasing force of the spring; simultaneously the lower projecting portions 46, as shown in FIG. 2B, are forced inwardly against the sides of the can thus denting and piercing its sides. As the piston continues to move downwardly, the upper edge of the piston passes the upper projecting portions of the pivotal arm thereby allowing the lower projecting portions of the arms to pivot away from the sides of the can. The piston continues to be forced toward the base until the can is crushed, as shown in FIG. 2C. Thereafter, the piston is withdrawn from the base end by moving handle 10 in the direction of arrow 66, thus forcing end 28 of the handle against the upper surface 61 of slot 24 (see FIG. 3). The crushed can is then removed from the tube; normally it will gravitationally drop through the can removal aperture 56.

Although the best mode contemplated for carrying out the present invention has been herein shown and described, it will be apparent that modificaton and variation may be made without departing from what is regarded to be the subject of the invention.

I claim:

1. An improved can crusher comprising:

a piston;

a base;

tube means attached to and extending transversely from the base and within which said piston can move along a path from an upper position remote from the base to a lower position proximate the base, the tube means including means for receiving and positioning a can to be crushed so that one end thereof is proximate the base;

means for urging said piston along said path from the upper towards the lower position into engagement with the can to thereby crush the can by removing the other end of the can towards said one end thereof, said urging means including a handle having a handlegrip portion, a piston-engaging portion and a pivot point between said handlegrip and piston-engaging portions;

arm means connected with the tube means and movable into engagement with a side of the can, said arm means having a can piercing portion for denting and piercing the side;

means, activated by the motion of the piston from the upper to the lower position, for moving the arm means to dent and pierce the can side before the piston moves the other can end toward the one can end to thereby facilitate the crushing of the can by the piston;

wherein the arm means moving means includes means connected with the piston for forcing said engaging means of said arm away from said path to thereby pivot said arm in a first direction and move said piercing means to pierce and dent the side of said can.

2. The can crusher of claim 1 wherein the piston includes an opening in a side of the piston, and wherein said piston-engaging portion of said handle extends through the opening to thereby engage the piston.

3. The can crusher of claim 2 wherein said piston has bearing means mounted to be contacted by the piston-engaging portion for reducing friction and the generation of transverse forces on said piston.

4. The can crusher of claim 2 wherein said piston-engaging portion of said handle is configured to engage said piston so that a resulting force urging the piston along said path to crush the can is generally parallel to said path to reduce transverse forces on said piston.

5. Apparatus for crushing metal cans by axially compressing them so that their respective ends are proximate and generally parallel to each other, the apparatus comprising:

a can holder including a base and a tube protruding transversely away from the base, the tube defining a cavity adapted to receive a can to be crushed generally parallel to the axis of the tube, the tube including a first cutout proximate the base sized to permit the insertion of the can therethrough into the cavity, the tube having an additional length terminating in a free end spaced from the cutout and from the base, said additional tube length including first and second generally diametrically opposite slots formed therein, one of the slots communicating with the first cutout;

a piston having a can engaging end and being axially movably disposed within the cavity for movement between a first position in which the piston end clears the can in the cavity and second position at which the piston end is relatively proximate to the base, said piston including first and second generally diametrically opposite apertures aligned with the slots;

means for reciprocating the piston between the first and second positions, said reciprocating means comprising an elongate handle having a first length extending generally radially through the slots and the apertures and a second length which is relatively remote from the tube, and means connected with the base mounting the handle and permitting pivotal handle motions about a pivot axis located between the first and second handle lengths, whereby pivotal movement of the handle causes corresponding axial movements of the piston along the cavity;

a piercing and denting arm mounted to the exterior of the tube generally parallel to the axis of the cavity and being pivotable about an axis that is transverse to the axis of the cavity, the arm defining first and second arm portions located, respectively, between the ends of the can in the cavity and at the additional length of tube;

the tube being formed so that the first and second arm portions can alternatively enter the cavity when the arm is pivoted in opposite directions;

means for pivotally biasing the arm so that the second portion is normally biased into the cavity;

said piston further including extension means engaging the second arm portion when the piston moves from the first to the second position and for pivotally moving the arm against a force exerted by the biasing means to enter the first arm portion into the cavity, engage a side of the can in the cavity with the first arm portion, and pierce and deform the can side before the piston end contacts the can to facilitate the crushing of the can by the piston, the piston further including retraction means permitting the biasing means to pivot the arm and permit the second arm portion to enter into the cavity to thereby correspondingly retract the first arm portion from the cavity before the piston arrives at its second position.

6. Apparatus according to claim 5 including a second cutout in the tube generally diametrically opposite from the first cutout, the second cutout being dimensioned so that the crushed can can be withdrawn from the cavity through the second cutout.

* * * * *